US006220773B1

(12) United States Patent
Wiegner et al.

(10) Patent No.: US 6,220,773 B1
(45) Date of Patent: Apr. 24, 2001

(54) CONTAINER FOR RECEIVING A FLUID, GEL-LIKE OR PASTY MEDIUM

(75) Inventors: Georg Wiegner, Flat E, 14th Floor, Hilton Tower, 96 Granville Road, Tsimshatsui, Kowloon, Hong Kong (CN); Hyeong Sook Kim, Kowloon (CN)

(73) Assignee: Georg Wiegner, Hong Kong (CN)

( * ) Notice: Subject to any disclaimer, the term of this patent is extended or adjusted under 35 U.S.C. 154(b) by 0 days.

(21) Appl. No.: 09/492,425

(22) Filed: Jan. 27, 2000

(30) Foreign Application Priority Data

Jan. 29, 1999 (DE) ..... 199 03 504

(51) Int. Cl.[7] ..... B43K 29/00

(52) U.S. Cl. ..... 401/195; 401/38; 401/39; 401/52

(58) Field of Search ..... 401/37–39, 195, 401/24, 18, 52, 118–122, 126, 127, 129

(56) References Cited

U.S. PATENT DOCUMENTS 5,284,239 * 2/1994 Kiricoples ..... 40/129
5,769,553 * 6/1998 Chaudhri et al. ..... 401/195
5,893,378 * 4/1999 Llerena ..... 401/195
6,010,265 * 1/2000 Bouix ..... 401/122
6,059,570 * 5/2000 Dragan et al. ..... 401/129

* cited by examiner

*Primary Examiner*—Gregory L. Huson
*Assistant Examiner*—Tuan Nguyen
(74) *Attorney, Agent, or Firm*—Steven F. Caserza; Flehr Hohbach Test Albritton & Herbert LLP

(57) ABSTRACT

A container for accommodating a fluid, gel-like or pasty medium in a container chamber into which it is possible to dip a brush and which has a removal opening in which there is seated a closure plug which tapers in a stub-like manner into the container chamber and has a through-passage for the introduction of a stem-mounted brush and for stripping the brush when the latter is drawn out of the container chamber, the stem being fastened, by way of an end which is located opposite the brush, on a container head which can be positioned on the removal opening in order for the brush to be stored in the container chamber, it being the case that the container chamber is filled with a breath-freshening oral-hygiene medium into which a brush in the form of an interdental brush for cleaning the spaces between the teeth is inserted in a withdrawable manner.

3 Claims, 1 Drawing Sheet

CONTAINER FOR RECEIVING A FLUID, GEL-LIKE OR PASTY MEDIUM

The invention relates to a container for receiving a fluid, gel-like or pasty medium according to the preamble of claim 1.

Such containers are known for the purpose of receiving mascara into which a mascara brush is inserted, as is described, for example, in DE 80 26 372 U1.

U.S. Pat. No. 4,810,122 likewise discloses a cosmetics container which accommodates a cosmetics material and has a brush which extends into the container.

EP 0 294 051 A2 discloses an interdental brush which can be used for cleaning the spaces between the teeth. In order to improve these cleaning properties, provision is made for the brushes of the brush section to be of a certain length.

DE 93 09 004 U1 discloses a toothbrush of which the toothbrush body can be filled with a toothpaste. The toothpaste accommodated by the toothbrush is fed, within the toothbrush body, to the toothbrush head in order to be dispensed in the region of the toothbrush head.

DE 89 11 487 U1 discloses a toothbrush which, at an end which is located opposite the toothbrush head, has an interdental brush over which it is possible to push the section of a handle shank.

The object of the present invention is to extend the application area of cosmetics containers.

This object is achieved by the features of claim 1.

This provides a container of the abovementioned type which, for cleaning the spaces between the teeth, makes available an interdental brush which is impregnated with an oral-hygiene medium and, in contrast to a hitherto-conventional toothpick or dental floss, can be used repeatedly since storage in the container, or at least brief insertion into the container, prepares the interdental brush for reuse. Furthermore, the interdental brush carries along oral-hygiene medium out of the container and introduces it into the spaces between the teeth which are to be cleaned. Such a combined effect of mechanical and chemical cleaning has not been possible to achieve up until now.

It is also advantageous that the container can be carried unobtrusively in one's pocket and is thus always at hand, for example following meals, during travelling, etc.

It is also possible for the container to be integrated in a toothbrush, for which purpose the toothbrush handle may be designed as a hollow handle in order to accommodate a container which, at an end which is remote from the toothbrush head, has the container head, which bears the interdental brush.

Further configurations of the invention can be gathered from the following description and from the subclaims.

Figure 1:
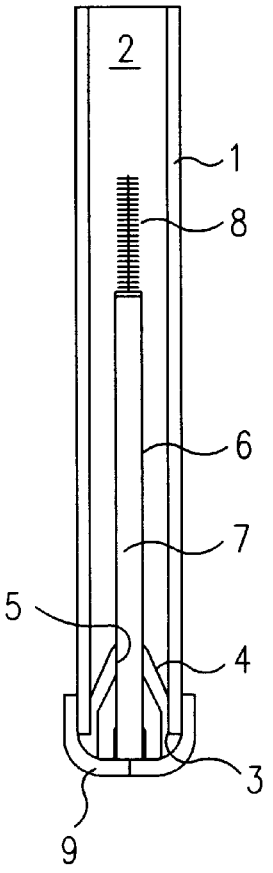
Figure 2:
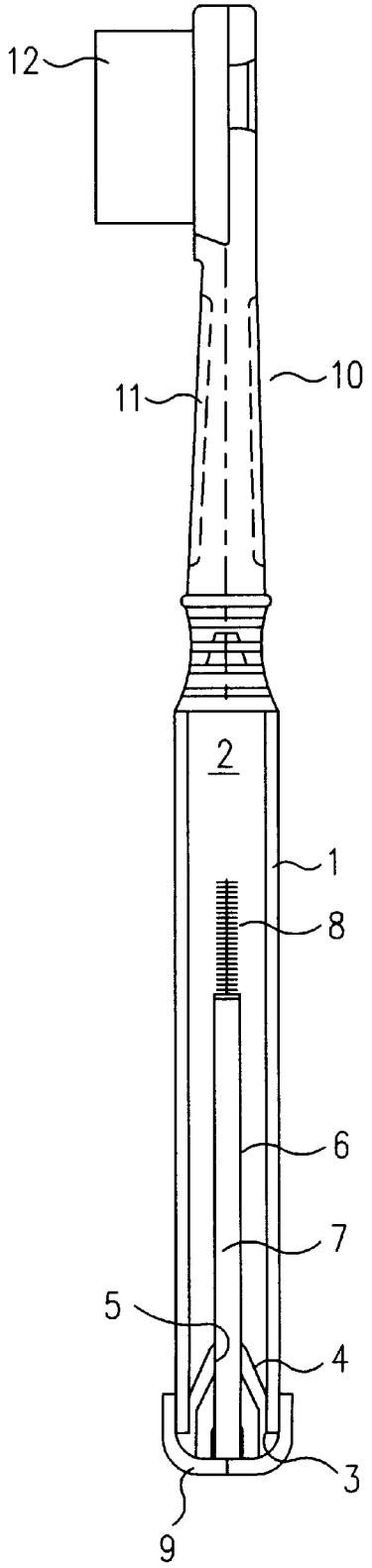

The invention is explained in more detail hereinbelow with reference to the exemplary embodiment illustrated in the attached drawing, in which FIG. 1 shows, schematically, a side view of a container according to the invention, FIG. 2 shows, schematically, a side view of a container formed on a toothbrush.

The invention relates to a container 1 in which there is formed a container chamber 2 which is provided for receiving a fluid, gel-like or pasty medium. In order to fill the container chamber 2, the latter has a removal opening 3 which can be closed off by means of a closure plug 4 which tapers in a stub-like manner into the container chamber 2. The closure plug 4 has a through-passage 5 for the introduction of a dental brush 6 with a stem 7 and a brush head 8 into the container 1, as a result of which the dental brush 6 is dipped into the medium in the container chamber 2. At an end which is located opposite the brush head 8, the stem 7 is fastened on a container head 9 which can be positioned on the removal opening 3, with the result that the container chamber 2 can be closed off in an airtight manner in order that the medium introduced into the container chamber 2 does not dry out.

By virtue of the container head 9 being removed from the container 2, the interdental brush 6 is drawn out of the container 1, the brush head 8 being stripped on the closure plug 4 in order that just a small quantity of medium is removed from the container chamber 2.

The interdental brush 6, which, by virtue of being dipped into the medium in the container chamber 2 and stripped on the closure plug 4, is wetted with a still-sufficient quantity of medium, can be used for cleaning the spaces between the teeth. Following use, the interdental brush 6 is introduced, possibly once it has been rinsed, into the container 2 again via the closure plug 4, the diameter of the through-passage 5 preferably being dimensioned such that the stem 7 of the interdental brush 6 closes off the through-passage 5. In this case, the interdental brush 6 is guided by way of the container head 9, which is seated on the stem 7. However, provision may also be made for the stem 7 to be seated releasably in the container head 9 in order that possibly the container head 9 does not constitute an obstruction during use of the interdental brush 6.

In order for the interdental brush 6 to be kept in the container chamber 2 for a relatively long period of time, it is possible for the container head 9 to be positioned on the container 2 in a gastight manner, for example by way of a screw closure or of a snap-action closure.

The fluid, gel-like or pasty medium is formed by a breath-freshening oral-hygiene medium which is preferably also suitable for destroying bacteria. It is possible to select any desired flavors.

The interdental brush 6 preferably has a brush head 8 of cylindrical form.

According to FIG. 2, the container 1 forms the stem or handle of a toothbrush 10. Fastened on the container 1, for this purpose, is a toothbrush neck 11 which bears a toothbrush head 12.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A toothbrush comprising a handle and a toothbrush neck fastened thereto bearing a toothbrush head, said handle forming a container comprising a container chamber for receiving a fluid, gel-like or pasty oral-hygiene medium having a container opening at an end remote from said toothbrush head, seated within said opening is a closure plug which tapers in a stub-like manner into said container chamber and has a through-passage for the introduction of a stem-mounted brush and for stripping the brush when said brush is drawn out of said container chamber, said stem-mounted brush being fastened with an end opposite the brush on a container head forming an interdental brush for cleaning and spaces between teeth, being inserted in a withdrawable manner into the container chamber and being stored in the container chamber by positioning said container head on said container opening.

2. The toothbrush as claimed in claim 1, wherein said interdental brush is of cylindrical form.

3. The toothbrush as claimed in claim 1, wherein said oral-hygiene medium is an antibacterial oral gel.

* * * * *

UNITED STATES PATENT AND TRADEMARK OFFICE

CERTIFICATE OF CORRECTION

PATENT NO. : 6,220,773 B1
DATED : April 24, 2001
INVENTOR(S) : Wiegner et al.

It is certified that error appears in the above-identified patent and that said Letters Patent is hereby corrected as shown below:

Column 2,
Line 58, delete “and”.

Signed and Sealed this

Eighteenth Day of June, 2002

*Attest:*

*Attesting Officer*

JAMES E. ROGAN
*Director of the United States Patent and Trademark Office*